United States Patent [19]

Hegyi

[11] Patent Number: 4,648,610

[45] Date of Patent: Mar. 10, 1987

[54] LIGHT EMITTING ROLLER SKATE WHEELS

[76] Inventor: James A. Hegyi, 15901 W. Mayflower Dr., New Berlin, Wis. 53151

[21] Appl. No.: 757,680

[22] Filed: Jul. 22, 1985

[51] Int. Cl.[4] ..... A63C 17/26

[52] U.S. Cl. ..... 280/11.19; 310/73; 362/192; 362/800; 446/438

[58] Field of Search ..... 280/11.19, 809, 816; 362/192, 193, 800; 301/5.3, 37 R, 37 CM, 5.7; 446/438, 462, 485; 310/73

[56] References Cited

U.S. PATENT DOCUMENTS

| | | | |
|---|---|---|---|
| 3,548,185 | 12/1970 | Hall | 310/73 |
| 3,732,560 | 5/1973 | Harden et al. | 362/800 |
| 3,789,208 | 1/1974 | Lewis | 280/816 |
| 3,792,307 | 2/1974 | Baker | 362/193 |
| 4,298,910 | 11/1981 | Price | 301/5.7 |
| 4,363,502 | 12/1982 | Bakerman | 301/5.7 |
| 4,367,515 | 1/1983 | Beard | 362/800 |

*Primary Examiner*—John J. Love
*Assistant Examiner*—Eric D. Culbreth

[57] ABSTRACT

This invention relates to an improved method of causing light to be emitted from a roller skate wheel. The light is produced with energy obtained from the motion of the wheel. This invention uses a permanent magnet and an electrically conducting coil, wound around a magnetically permeable core, to produce electrical energy. The energy is used to produce an electric current through a light emitting diode, which results in light being emitted from the body of the wheel when the wheel rotates.

2 Claims, 6 Drawing Figures

LIGHT EMITTING ROLLER SKATE WHEELS

BACKGROUND OF THE INVENTION

1. Field of the Invention

Wheels for roller skates must be durable, resilient and preferably, inexpensive to manufacture. Typically, a wheel is molded from polyurethane in a single operation, resulting in a wheel that has all of the properties listed above and a wheel that is capable of accepting and supporting bearings without additional components or structures.

Adding the feature of having flashing lights mounted on a wheel will significantly affect its marketability. A wheel with flashing lights must, of course, retain the properties of durability, resilience and particularly, low manufacturing cost, or any marketing advantage will be lost. It has not been possible heretofore to provide a wheel having flashing lights that retains all of these desirable properties.

2. Description of Prior Art

Price, in U.S. Pat. No. 4,298,910, discloses a wheel whereby an electric generator is contained within the wheel. Price's wheel uses a stationary body mounted between the wheel bearings. The mounting of the stationary body creates a problem in that material must be removed in the area between the bearings to make room for the stationary body. The loss of this material requires that additional rigid structures must be added to support the outer bearing race for both the inner and outer bearing assembly. The resultant wheel is a relatively complicated device that requires precision components for supporting the bearings, windings and magnet. Additionally, the "generator" portion of the wheel would presumably require bonding to an outer covering material that would exhibit the resilient properties required for roller skate wheels. The result of these requirements are increased manufacturing costs.

A solution to the problems created by employing an inner stationary body to mount the permanent magnet is to mount the magnet externally to the body of the skate wheel. This has not been possible prior to the present invention for the following reasons:

(a) The windings cannot be mounted close to the surface of the wheel that contacts the surface the wheel moves over, since any wear and tear on this outer surface would expose and damage the windings. Additionally, an external magnet mounted close to this wheel surface might easily jam the wheel when debris or pebbles picked up by the wheel attempted to pass through the necessary gap between the wheel surface and magnet.

(b) A winding mounted near one of the inner or outer wheel surfaces, that is, one of the surfaces that is oriented perpendicular to the axle, would necessarily be small, and not capable of producing enough electrical energy to energize a light emitting means. The diameter of such a winding must necessarily be small to allow the winding to fit between the outer bearing race and the outer radius of the wheel. Increasing the thickness of windings mounted in this position would not solve the problem, since the magnetic reluctance of the windings and the material the wheel is constructed of is high, and therefore the portion of the windings not close to the magnet would move through a weakened magnetic field, generating little electrical energy.

OBJECT OF THE INVENTION

It is therefore the object of the present invention to provide a light emitting roller skate wheel that utilizes a permanent magnet, an electrically conducting coil, a magnetically permeable coil core and a light emitting means, characterized by a two-color light emitting diode. It is additionally the object of the present invention to disclose a light emitting roller skate wheel that is durable, resilient and inexpensive to manufacture. It is further the object of the present invention to disclose a light emitting roller skate wheel that may be constructed by converting an ordinary roller skate wheel into a light emitting roller skate wheel.

SUMMARY OF THE INVENTION

In carrying out principles of the present invention in accordance with a preferred embodiment thereof, a mounting means, external to a light emitting roller skate wheel, is secured to a roller skate truck. A permanent magnet, characterized by a magnet with both pole ends resting in the same plane, is secured to the mounting means, in such a way as to cause both pole ends to be near, but not touching, the inner surface of said wheel. A spacing means is placed on the roller skate axle, such that a space exists between said mounting means and said wheel. A coil, characterized by a coil consisting of magnet wire wound around a ferrous core, is embedded within the body of said wheel, such that the core of said coil exhibits a magnetic flux coupling relationship with said magnet upon rotation of said wheel. A light emitting means characterized by a two-color light emitting diode, is embedded within the body of said wheel, and is electrically connected to said coil. Upon rotation of said wheel, electrical energy is produced by said coil, which causes electrical current to flow through said light emitting means, resulting in the emission of light from said wheel.

DETAILED DESCRIPTION OF THE INVENTION

Figure 1:
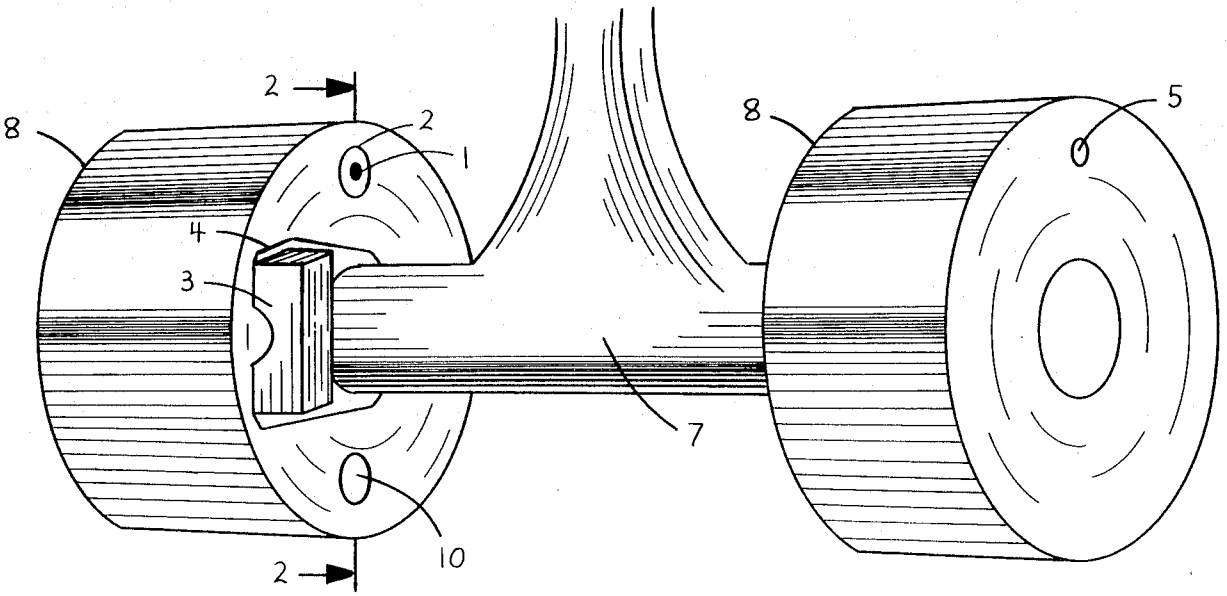
FIG. 1 is a perspective view of the invention as applied to 2 roller skate wheels mounted on the truck of a roller skate.
Figure 2:
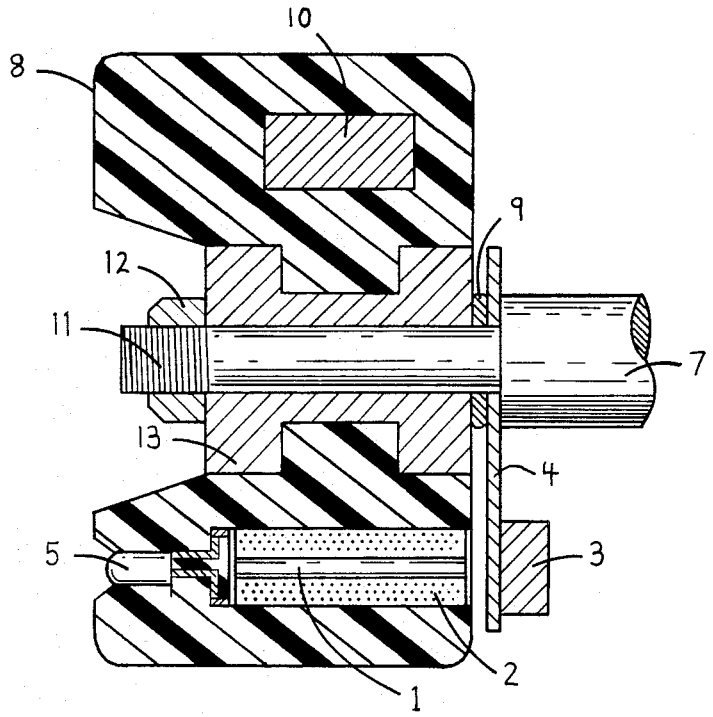
FIG. 2 is an enlarged cross section of one of the wheels of FIG. 1, taken in the direction of the arrows 2—2 of FIG. 1.
Figure 5:
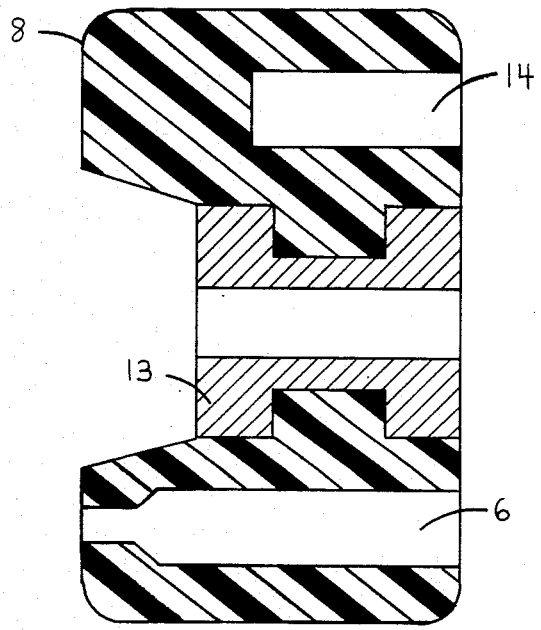
FIG. 5 is an enlarged cross section of one of the wheels of FIG. 1, taken in the direction of the arrows 2—2 of FIG. 1, prior to the insertion of the principal components of the invention.

Referring to FIG. 5, the conversion of an ordinary roller skate wheel into a light emitting roller skate wheel begins by drilling two holes, 14 and 6 into the body of the wheel. Referring now to FIG. 2, a coil 2, consisting of magnet wire, is wound around a coil core 1. The ends of the coil 2 are electrically connected to a two-color light emitting diode (LED) 5. The coil 2, coil core 1, and LED are inserted into the hole 6 of FIG. 5.

Referring again to FIG. 2, LED 5 is positioned such that the top of the LED is very close to the outer edge of the wheel 8. A mounting means 4 is attached to the truck 7 of a roller skate. A spacing means 9 is placed between the wheel 8 and mounting means 4. A permanent magnet 3 is attached to the mounting means 4 so that the pole ends of the magnet face the inside surface of the wheel 8. The wheel bearing assembly 13, axle 11 and wheel securing nut 12 are typical of current roller skate wheel construction. A counter weight 10 is placed into the hole 14 of FIG. 5 to restore balance to the wheel 8.

Figure 3:
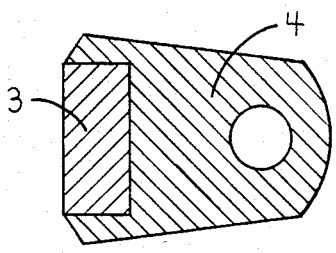
FIG. 3 is a side view of the mounting means and permanent magnet.

FIG. 3 defines the mounting means 4 and the position of the attached permanent magnet 3.

Figure 4:
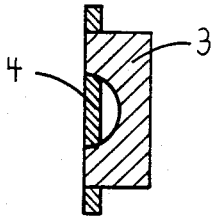
FIG. 4 is a front view of the mounting means and permanent magnet.

FIG. 4 further defines the relationship between the mounting means 4 and the attached permanent magnet 3.

Figure 6:
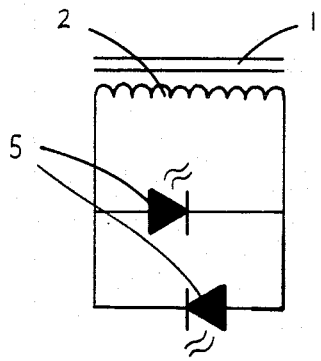
FIG. 6 is a schematic electrical circuit diagram illustrating the manner of connection between the coil core, coil, and two-color light emitting diode.

FIG. 6 defines the electrical connections between the coil 2 and LED 5. Also shown in FIG. 6 is the magnetic relationship between the coil core 1 and the coil 2.

The present invention operates in the following manner: As the wheel 8 rotates, the coil core 1 and coil 2 periodically exhibit a magnetic flux coupling relationship with the permanent magnet 3. The result of this relationship is the periodic formation and collapse of a magnet field around the windings 2, resulting in electrical energy being generated in the windings 2 and energizing the LED 5.

It is of course possible to form the present invention by embedding components in the wheel material during the casting of the wheel. It is also obvious that a multiplicity of LEDs and coils and coil cores may be embedded within the wheel material to effect variations of appearance and light output of the invention. It is also obvious that variations in the structure and mounting of the permanent magnet are possible, without effecting the basic operation of the invention.

The foregoing specification describes a preferred embodiment of the present invention. Variations in the form, construction and arrangement of the principal components are possible without departing from the spirit and scope of the appended claims.

I claim:

1. A light emitting roller skate wheel including, in combination, a permanent magnet, an electrically conducting coil embedded in the body of said wheel, a light emitting means embedded in the body of said wheel and electrically connected to said coil so that electrical energy generated by said coil energizes said light emitting means, said coil moving in a circular path upon rotation of said wheel, characterized in that a coil core composed of material capable of being magnetically attracted by said magnet is embedded in the body of said wheel so that said coil encircles said core, said magnet being mounted nonrotatably externally to the body of said wheel and extending for an arcuate portion of said circular path so that upon rotation of said wheel said core is periodically in a magnetic flux coupling relationship with said magnet, said coil being periodically in a magnetic flux coupling relationship with said core, so that said coil periodically generates electrical energy.

2. A light emitting roller skate wheel according to claim 1, said magnet being attached to a mounting means, said mounting means being attached to a truck of a roller skate.

* * * * *